US006578814B2

(12) United States Patent
Hoyle et al.

(10) Patent No.: US 6,578,814 B2
(45) Date of Patent: Jun. 17, 2003

(54) CONCRETE FLAT WORK FORM

(75) Inventors: Terry Hoyle, Englewood, CO (US); Michael Turner, Littleton, CO (US)

(73) Assignee: Surevoid Products, Inc., Englewood, CO (US)

( * ) Notice: Subject to any disclaimer, the term of this patent is extended or adjusted under 35 U.S.C. 154(b) by 110 days.

(21) Appl. No.: 09/827,151

(22) Filed: Apr. 5, 2001

(65) Prior Publication Data

US 2002/0145099 A1 Oct. 10, 2002

(51) Int. Cl.[7] ..... E04G 11/36

(52) U.S. Cl. ..... 249/3

(58) Field of Search ..... 249/2, 3, 4, 5, 249/6, 7, 8, 9; 428/542.8

(56) References Cited

U.S. PATENT DOCUMENTS 1,477,767 A * 12/1923 Pulis ..... 249/7
5,836,254 A * 11/1998 Johansson ..... 108/51.3

* cited by examiner

*Primary Examiner*—Michael Safavi
(74) *Attorney, Agent, or Firm*—Richard W. Hanes; Hanes & Schutz, P.C.

(57) ABSTRACT

An expendable article for forming the side edge of a poured in place concrete structure. The article is formed as a fabricated, elongated hollow corrugated paper box having three interconnected sides that together define in cross section a right triangular shape, including a hypotenuse side and a base side with at least two sides formed of at least two layers of corrugated paper. Vertically aligned apertures are formed in the hypotenuse and base sides for receiving therethrough a retaining stake. The form being left in place to disintergrate after a period of time.

3 Claims, 6 Drawing Sheets

CONCRETE FLAT WORK FORM

The present invention relates to forms for relatively thin thickness concrete structures such as sidewalks, driveways, curbing, slabs and the like.

BACKGROUND

Forms for retaining wet concrete as part of the process of molding a relatively thin concrete flat work structure such as a sidewalk, driveway or slab, are quite often fabricated out of dimension lumber, such as a conventional two-by-four or a two-by-six. One or more two-by-fours, for example, are secured end to end on grade to become the form that defines one side edge of the concrete structure to be poured. Wooden or metal retaining stakes are driven into the ground adjacent the exterior side of each two-by-four to secure it in position against the pressure of the concrete poured between forms laid on each side of the structure to be poured. After the concrete has cured, traditional practice dictates that the retaining stakes and the two-by-fours be removed from the sides of the concrete structure. Following extraction of the stakes and forms, soil or other material is back-filled against the sides of the structure to produce an overall level surface with the top of the poured structure.

Several problems arise from this conventional method of erecting and stripping forms for a concrete flat work structure. First, wooden forms, described, must be removed after the concrete has cured, requiring manpower, time and expense. Secondly, after some use, the wooden form boards warp and bend, contributing to poor concrete edges and making the setting of the forms more difficult and time consuming. Sizing wooden forms to a particular job requires that the forming boards be cut to length, reducing their usefulness in future forming operations, thus wasting material.

Accordingly, the primary objective of the present invention is to provide a form for relatively thin, flat concrete work such as sidewalks, driveways and the like that eliminates the problems inherent in the use of the traditional wooden forming boards. This objective is affected by providing an expendable paper form that does not need to be removed from the structure following curing of the concrete. The corrugated paper form is left in place and soil or other back-fill material is deposited over the paper form which, after a period of time, disintegrates and is otherwise unobtrusive.

A second objective of the invention is to provide a disposable concrete form that can be transported in a flat, space-saving conformation and assembled for use at the job site.

SUMMARY OF THE INVENTION

The present invention provides an expendable corrugated paper form for concrete work that does not require stripping or removal following curing of the concrete. Instead of removing the paper form, it is left in place and soil or other back-fill material is deposited over it. The paper form disintegrates after a period of time.

To maximize shipping efficiency, the corrugated paper form is preferably assembled at the construction site from a flat blank. The blank has previously been prepared with scored folding lines and retaining stake apertures have been cut into the blank. When assembled, the folded and taped blank produces a sturdy box having a triangular cross-section and having vertically aligned apertures in the two sides of the box that define the base and hypotenuse of the triangular shape. Preferably, the box's triangular shape is that of a right triangle where the base side is laid against the surface grade and the height side is disposed vertically to serve as the form against which the wet concrete is poured to create the desired structure. The aligned apertures in the hypotenuse and base of the box are positioned to receive one or more spaced apart stakes that protrude through the base and are driven into the ground on which the box form lies. In each of such forms, there are a plurality of apertures along its length to receive retaining stakes at intervals that are appropriate. The stakes secure the form box in its desired position and support it against the lateral pressure of the concrete against the height side. The box can be of any convenient length but preferably the blanks that form the box are made in standard six or eight foot lengths to produce a convenient working length for each form box.

DRAWINGS

DETAILED DESCRIPTION OF PREFERRED EMBODIMENT

To replace the traditional wooden or metal forms that retain and shape wet concrete in flat work structures, the forms of the present invention are preferably constructed of expendable corrugated paper. The forms are intended for a single use, eliminating the need to strip them from the sides of the cured concrete. Being constructed of degradable material, the forms are left in place after the concrete has cured. The gauge or size of the corrugated paper used to construct the form box is a matter of structural choice. However, the preferred form of the box utilizes an inexpensive single-ply corrugated paper that achieves its structural strength and integrity from multiple thickness walls that derive from the novel folded construction of the preferred form of the invention.

It is recognized that a concrete form that will accomplish the objects of the invention can be made of corrugated paper, or similar material, and be constructed using a variety of differently designed blanks and folding patterns. It is not intended that the claims to this invention be limited to the particular blank and folding pattern disclosed herein. However, the blank and the folding pattern shown in the accompanying drawings has been demonstrated to be strong and durable enough to withstand the rigors of setting the forms and pouring and finishing the concrete, yet economical and easy to fabricate and assemble on the job site. Accordingly, the preferred pattern of a forming box of the present invention will be described, along with the method for its use.

Figure 1:
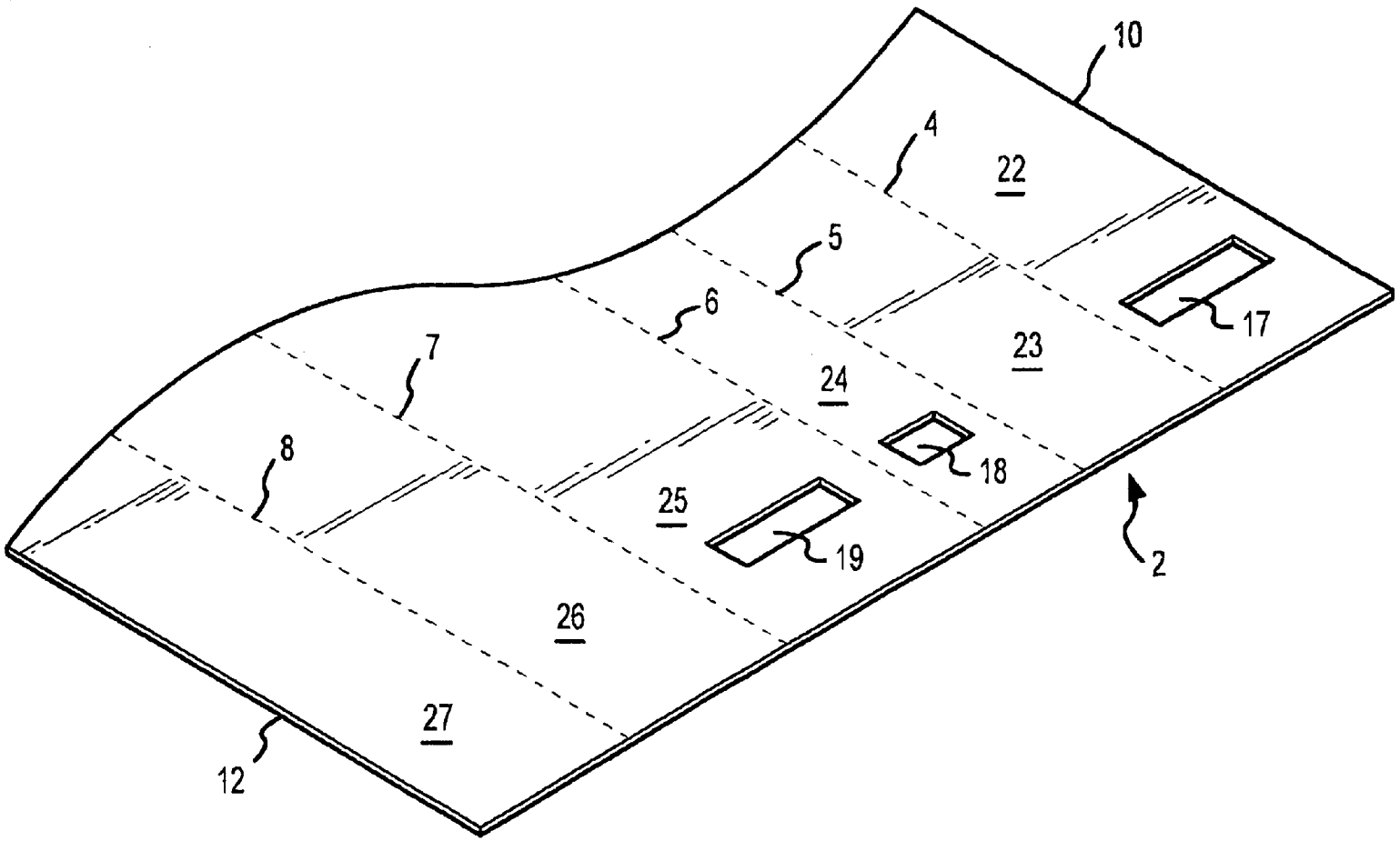
FIG. 1 is a fragmentary perspective view of a corrugated paper blank used for fabricating the concrete box form of the present invention. Dashed lines represent scored folding lines on the blank.
Figure 5:
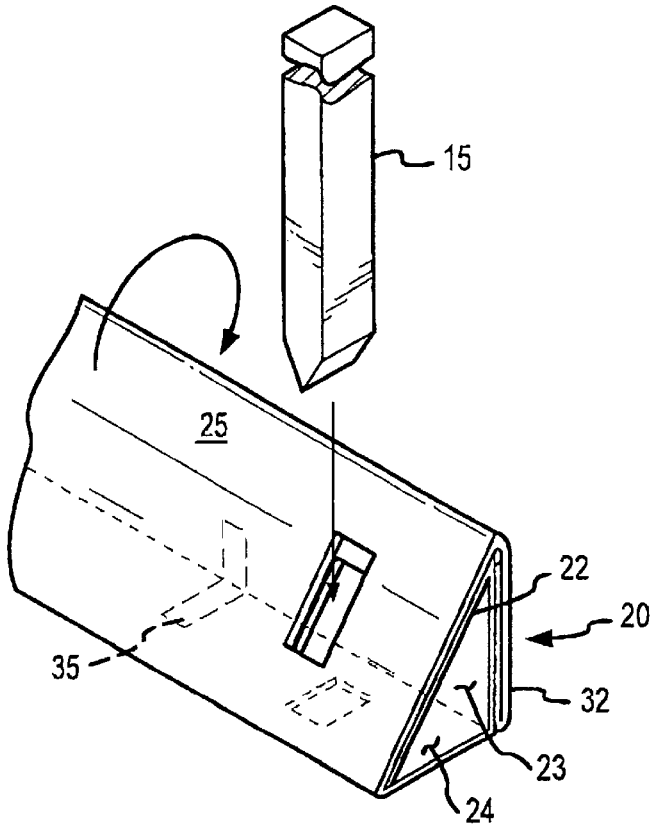
FIG. 5 shows the completed box with the hidden edge being held together with a piece of tape, shown in dotted lines and with a retaining stake in position to be inserted into the aligned apertures in the hypotenuse and base sides of the triangularly shaped box.
Figure 6:
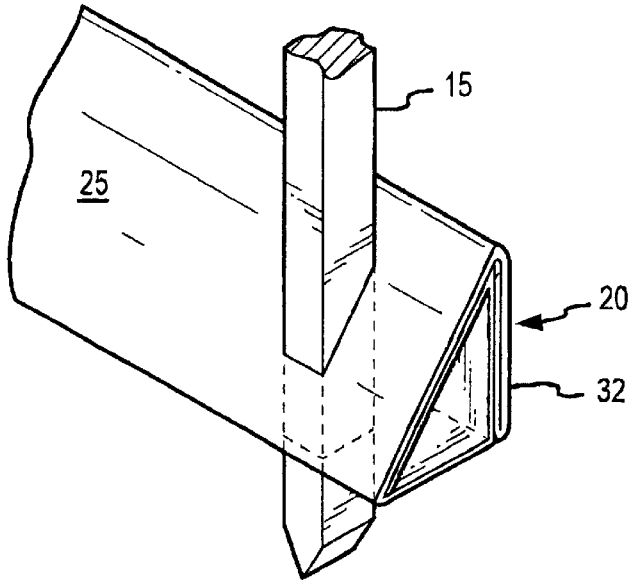
FIG. 6 is a fragmentary perspective view of the corrugated paper forming box. An exemplary retaining stake is shown inserted into and through the body of the box.
Figure 7:
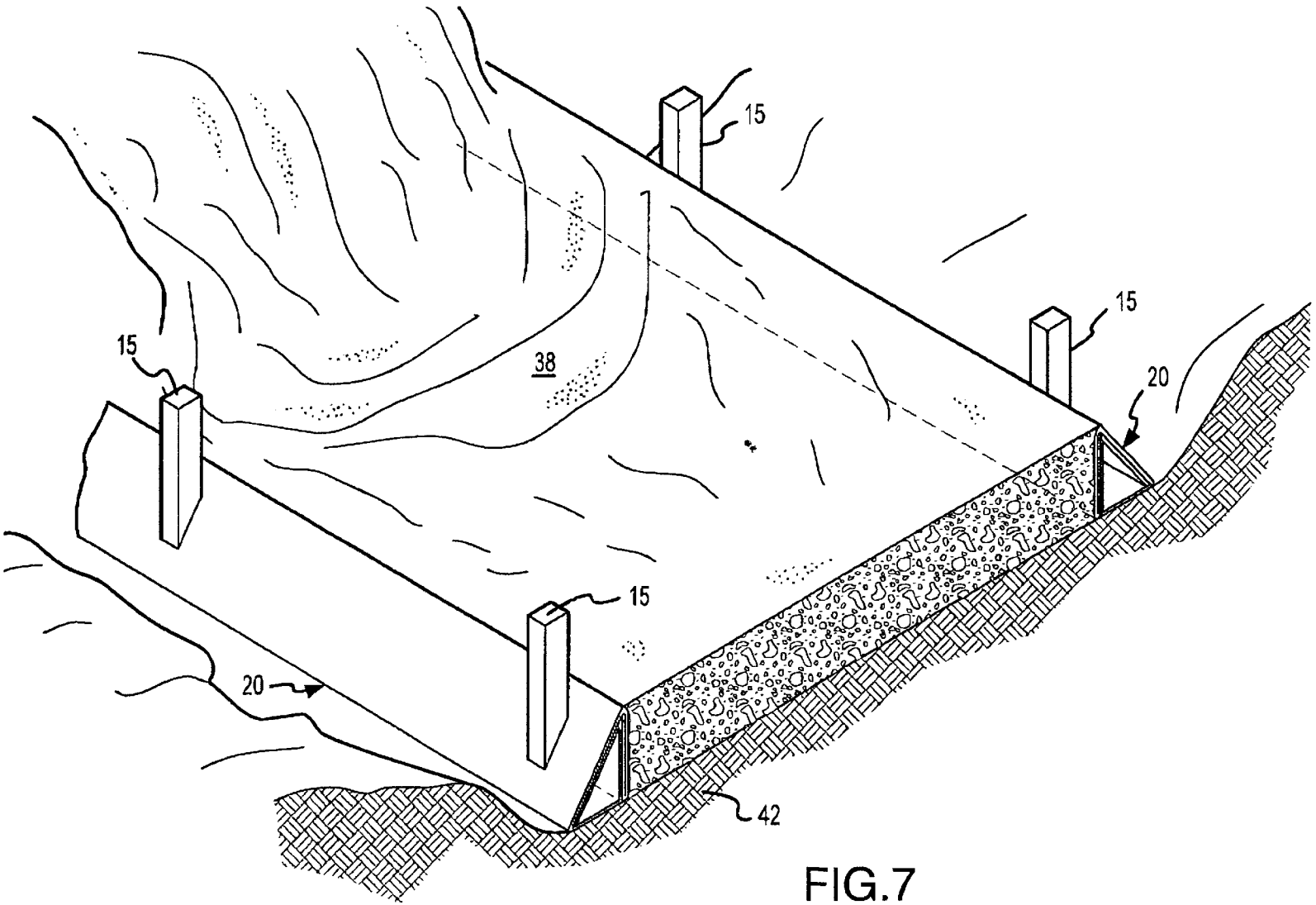
FIG. 7 is a perspective fragmentary view of an exemplary sidewalk, or similar flat work structure, with wet concrete being poured into the form created by laterally spaced apart form boxes of the present invention. The near end of the sidewalk, the supporting ground surface and the forms of the present invention are shown in cross section.

Because shipping and transporting a hollow box is, by definition, a waste of cargo space, the preferred embodiment of the form box contemplates a number of prepared blanks that are stacked flat for transportation to the job site. A blank comprises a six to eight foot long sheet of rectangularly shaped corrugated paper that is assembled into a single section of the form. FIG. 1 fragmentarily illustrates a short piece of such a blank 2. In order to easily assemble the preferred form box, the blank is provided with a plurality of spaced apart scored fold lines 4, 5, 6, 7 and 8 that are parallel with the parallel lateral sides 10 and 12 of the blank 2. A plurality of apertures 17, 18 and 19 are punched into the blank to provide suitable openings in the base and hypotenuse sides of the box through which a retaining stake 15 can be driven, as shown in FIGS. 5–7. The apertures shown in the drawings are indicated to be rectangular in shape, in contemplation of receiving a one-by-two inch wooden stake, for example. However, the word "aperture," as used in this specification and the following claims, should be interpreted to have additional meaning. In accordance with this invention, the word "aperture" or "apertures" is intended to encompass rectangular, circular or other shaped openings. The word also includes an "X" shaped or starburst cut, having slits in the corrugated paper that radiate from a center point. Either the X shaped or the starburst cut or any similar type of cutting pattern will provide for easy penetration of the box sides by a metal or wooden stake, regardless of the cross sectional shape of the stake.

On the construction site, each form box 20 is assembled as shown in FIGS. 2 through 5. In order to clearly describe the steps of the fabrication and assembly process, the rectangular portions of the blank 2 that lie between the lateral sides 10 and 12 of the blank and the scored folding lines 4 and 8 respectively and between the scored folding lines 4–8 will be referred to as side-forming walls, inasmuch as these areas of the blank become walls of the triangular box after the fabrication has been completed. The multiple side forming walls as shown in the drawings are referred to herein by reference numerals 22, 23, 24, 25, 26 and 27 and will be further identified as the first, second, third fourth, fifth and sixth walls, respectively.

Figure 2:
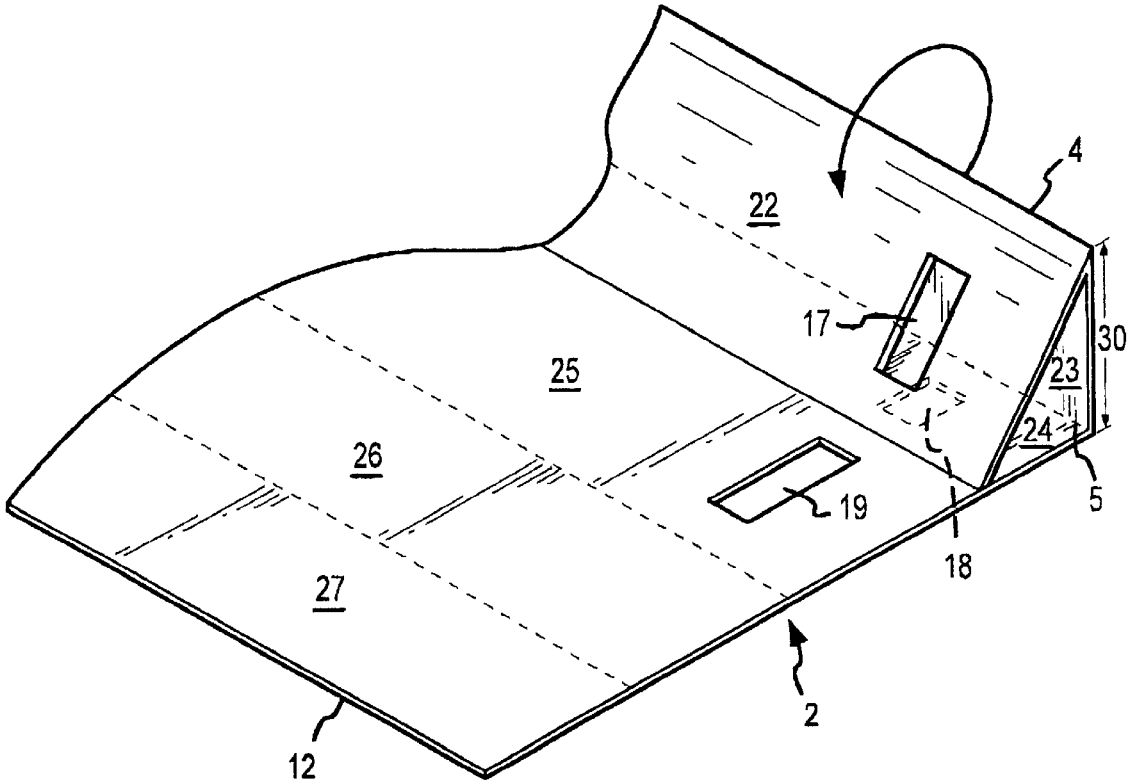
FIG. 2 illustrates the first step in producing the forming box from the blank of FIG. 1.

The first step in the fabrication process is shown in FIG. 2 where the blank 2 is folded along the second score line 5 to form a right angle between the second and third walls, 23 and 24. The first wall 22 is folded along the first score line 4 so that the first lateral edge 10 of the blank abuts the area of the third wall 24 just inside the third score line 6. The angle of the bend along the first score line 4 depends on the width of the second wall 23 which in turn depends on the desired height 30 of the concrete form and of the triangle forming the box 20.

Figure 3:
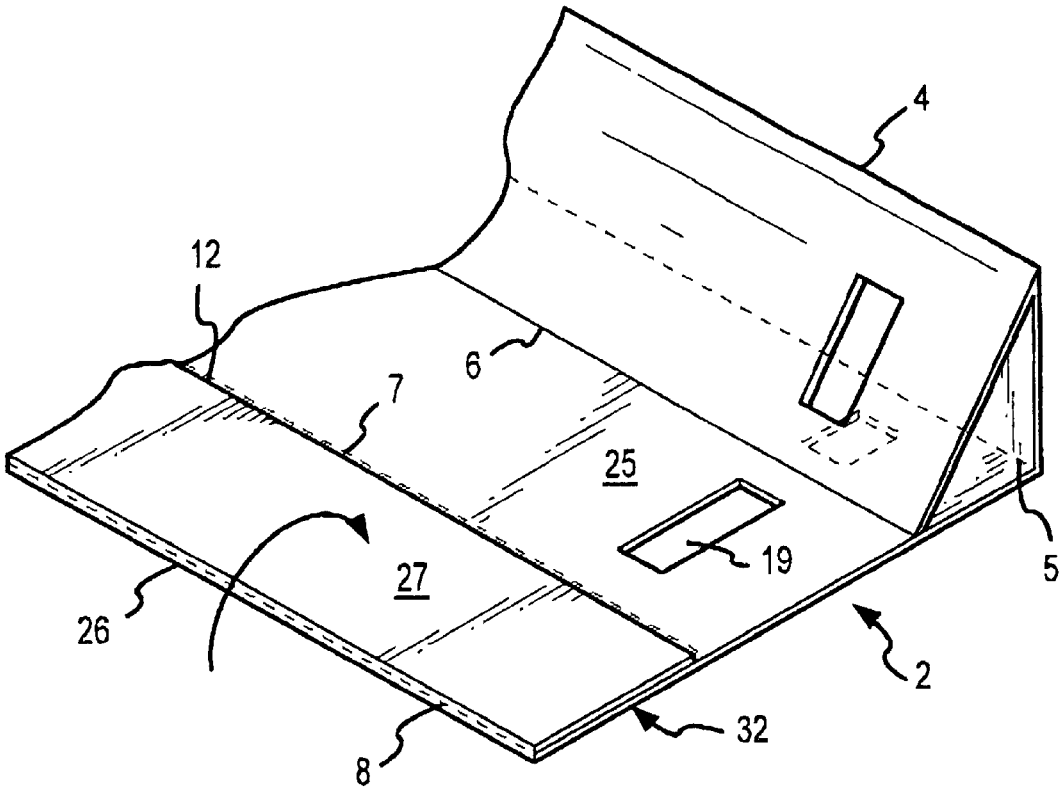
FIG. 3 illustrates the second step in folding portions of the blank to produce the concrete forming box of the present invention.

The second step of the fabrication process, as shown in FIG. 3, is to fold the sixth wall 27 over onto the surface of the fifth wall 26 so as to form a double thickness wall 32.

Figure 4:
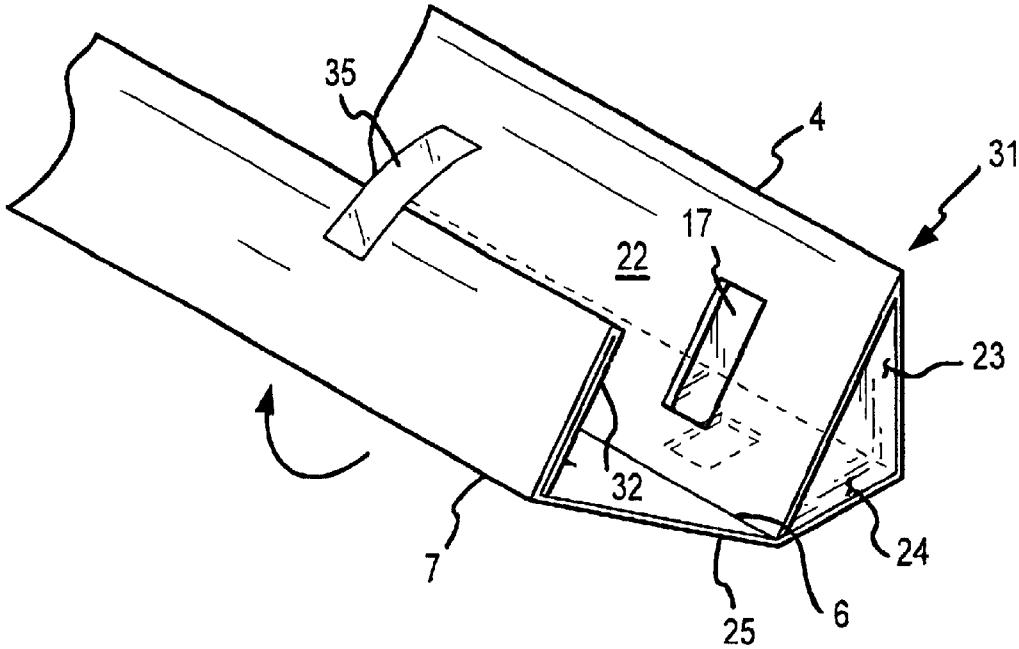
FIG. 4 illustrates the third step involved in creating the box of the present invention.

Next, as shown in FIG. 4, the double wall 32 is folded toward the fourth wall 25 and the fourth wall is folded toward an already formed triangular shaped box 31. Fastening tape 35 is placed on the double wall 32 in anticipation of attaching the parts together.

FIG. 5 illustrates the final step in the assembly process. Folding along the third score line 6 brings the fourth wall 25 into face-to-face contact with the first wall 22 and folding along the fourth score line 7 enables the double wall 32 to come into face-to-face contact with the outside of the second wall 23. The tape 35 is fastened around the right angle bend between the base of the formed triangle and the outside surface of the double wall 32. The tape connection maintains the folded blank in the form of the box 20. Although only one tape fastening is shown, a plurality of such taped connections should be made along the length of the box in order to keep the box together for the concrete pouring operation.

It is seen from the illustrative assembly drawings of FIGS. 2–5 that, when folded into the triangular box shape, the apertures 16–19 align themselves vertically in the hypotenuse and base sides of the triangular box. This alignment permits a stake 15 to be inserted into the apertures and driven into the ground below the base side of the triangular box 20. A plurality of retaining stakes 15 are spaced apart along the length of a section of form in order to secure the form box 20 in place during the pouring and curing of the concrete.

Figure 8:
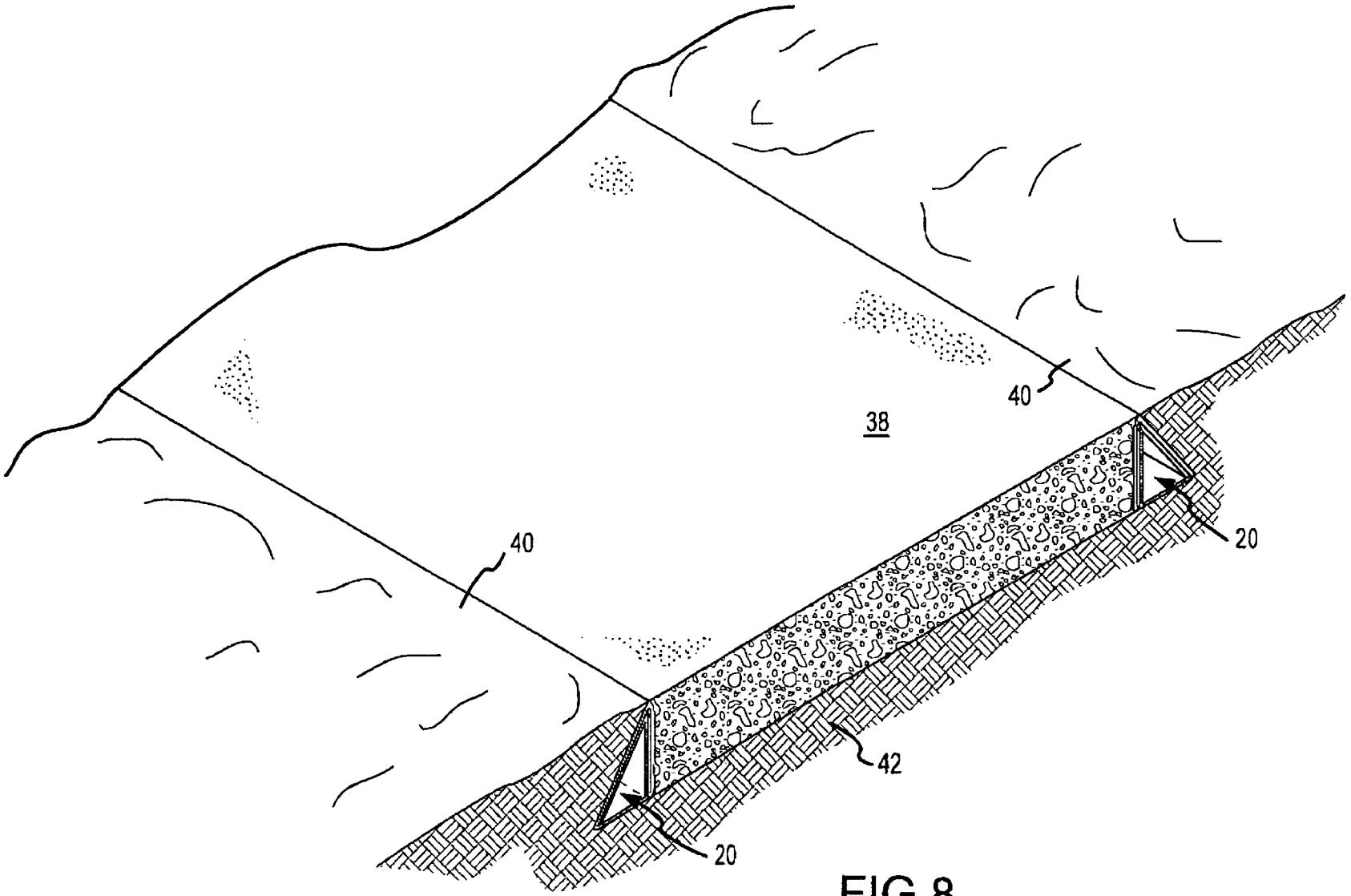
FIG. 8 is a perspective fragmentary view of a completed concrete structure, such as a sidewalk. A cross section showing the backfill material covering the forming boxes of the present invention is also shown.

The form boxes 20 are shown in FIG. 7 as they would appear as forms for molding a concrete sidewalk. Concrete 38 is poured between two opposing and spaced apart form boxes 20, each of which is held in place by a plurality of stakes 15 that penetrate the form boxes through the aligned apertures and are driven into the ground 42, as previously described. The stakes may be driven into the supporting soil a distance sufficient to provide securing stability but to also leave enough of the stake available for a hand hold to pull the stake out of the ground after the concrete has cured. When the stakes 15 are removed, soil or other material 40 is back filled over the form boxes 20, as shown in FIG. 8. The expendable corrugated paper boxes 20 need not be removed.

If the stakes 15 are not to be removed and are to be sacrificed with the corrugated paper form boxes, the stakes would be driven so that their top surface would be almost flush with the hypotenuse side 25 of the triangular box. In such case, the stakes would serve their retaining function but would be out of sight when the back fill was applied over the form box 20.

As seen, the present invention provides a cheap expendable corrugated paper form for concrete molding that is efficient to transport, easy to fabricate on the job and serves the same function as the traditional wooden form without the need to reclaim the form following the curing of the concrete.

We claim:

1. An article for forming wet concrete comprising,

A hollow box having interconnected sides that together define a triangular shaped lateral cross section of the box, including a hypotenuse side, a base side and a height side, said box being formed from a foldable blank of rectangularly shaped material having parallel lateral sides and having first, second, third, fourth and fifth spaced apart scored folding lines parallel to the lateral sides, said lines defining on the blank from one lateral side to the other in order, first, second, third, fourth, fifth and sixth side-forming wall areas where, when shaped by folding on the scored lines, the third wall area defines the base side, the second wall area defines the height side and the first wall area defines the hypotenuse side of the triangular box, the sixth wall area, folded back upon the fifth wall area, defines a double thickness of material, the fourth wall area overlies the hypotenuse-forming first wall area, and the double thickness of material formed by the fifth and sixth wall areas overlies the height side.

2. The article of claim 1 and further including, aligned apertures disposed in the hypotenuse side and the base side.

3. An article for forming wet concrete comprising,

An elongated hollow box having three interconnected sides formed from a single foldable blank of corrugated paper and forming in lateral cross section a right triangle, including a hypotenuse side, a base side and a height side, at least two of said sides comprising at least two layers of corrugated paper, at least one aperture in the base side, and at least one aperture in the hypotenuse side that is aligned with the base side aperture along an axis that is parallel to the height side.

* * * * *